US006276977B1

(12) United States Patent
Treinen et al.

(10) Patent No.: US 6,276,977 B1
(45) Date of Patent: Aug. 21, 2001

(54) INTEGRATED HYDRAULIC STEERING ACTUATOR

(75) Inventors: Kerry J. Treinen, Malone; Steven J. Amerling, Fond du Lac; Brian L. Fisher, Oakfield, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/551,201

(22) Filed: Apr. 17, 2000

(51) Int. Cl.[7] ..... B63H 20/12
(52) U.S. Cl. ..... 440/61; 114/150; 440/2
(58) Field of Search ..... 114/150; 440/61, 440/2

(56) References Cited

U.S. PATENT DOCUMENTS

| | | | | |
|---|---|---|---|---|
| 3,844,247 | * | 10/1974 | Collis et al. . | |
| 4,050,359 | * | 9/1977 | Mayer . | |
| 4,615,290 | | 10/1986 | Hall | 114/150 |
| 4,632,049 | | 12/1986 | Hall et al. | 114/150 |
| 4,710,141 | | 12/1987 | Ferguson | 440/61 |
| 5,002,510 | | 3/1991 | Rump | 440/61 |
| 5,092,801 | | 3/1992 | McBeth | 440/61 |
| 5,244,426 | | 9/1993 | Miyashita et al. | 440/60 |
| 5,330,375 | | 7/1994 | Tsujii et al. | 440/61 |
| 5,542,864 | | 8/1996 | Peebles | 440/61 |
| 5,924,379 | | 7/1999 | Masini | 114/150 |
| 5,997,370 | | 12/1999 | Fetchko et al. | 440/61 |

FOREIGN PATENT DOCUMENTS

| | | | | |
|---|---|---|---|---|
| 0123456 | * | 1/2000 | (EP) | 100/100 |
| 6-156389 | * | 6/1994 | (JP) . | |

OTHER PUBLICATIONS

Brochure, Teleflex, Inc. featuring Seastar brand.
Brochure, Hynautic Company.

* cited by examiner

*Primary Examiner*—Sherman Basinger
(74) *Attorney, Agent, or Firm*—William D. Lanyi

(57) ABSTRACT

A hydraulic actuator is provided for an outboard motor system in which the cylinder and piston of the actuator are disposed within a cylindrical cavity inside a cylindrical portion of a swivel bracket. The piston within the cylinder of the actuator is attached to at least one rod that extends through clearance holes of a clamp bracket and is connectable to a steering arm of an outboard motor. The one or more rods attached to the piston are aligned coaxially with an axis of rotation about which the swivel bracket rotates when the outboard motor is trimmed. As a result, no relative movement occurs between the outboard motor, the rod attached to the piston of the actuator, and the swivel bracket during rotation of the outboard motor about the axis of rotation.

19 Claims, 7 Drawing Sheets

INTEGRATED HYDRAULIC STEERING ACTUATOR

BACKGROUND OF THE INVENTION

1. Field of the Invention

The present invention is generally related to an integrated hydraulic steering actuator and, more particularly, to an actuator for an outboard motor that comprises a hydraulic cylinder that is located within a generally cylindrical portion of a swivel bracket attached to the outboard motor and rotatable relative to a clamp bracket that is attached to a boat.

2. Description of the Prior Art

Many different types of steering actuators are well known to those skilled in the art of marine propulsion systems. Steering can be accomplished with a mechanical system comprising cables that are attached between a steering wheel and an outboard motor. Hydraulic steering systems generally utilize a hydraulic pump that is actuated by a steering wheel and connected in fluid communication with a hydraulic cylinder attached to the outboard motor. Power steering systems generally use a pump that is actuated in response to movement of a steering wheel, wherein the pump is associated with appropriate valving to provide pressurized hydraulic fluid to a hydraulic cylinder attached to the outboard motor.

U.S. Pat. No. 5,997,370, which issued to Fetchko et al on Dec. 7, 1999, describes an outboard hydraulic steering assembly with reduced support bracket rotation. The assembly supplies a force to a tiller arm of a marine outboard propulsion unit and rotates the propulsion about a steering axis between a center position and hard over positions to each side of the center position. The propulsion unit is supported for arcuate movement about a tilt axis which is generally perpendicular to the steering axis. The steering assembly includes a hydraulic steering cylinder with an elongated piston rod reciprocatingly mounted within the cylinder for movement along a piston rod axis. A pair of support arms are pivotable about the tilt axis and are connected to the piston rod, allowing arcuate movement of the rod about the tilt axis, while maintaining the rod axis parallel to the tilt axis. A member is pivotally mounted on the tiller arm for pivoting about a first axis which is parallel to the steering axis. The cylinder arm is connected to the cylinder and extends radially outwards from the piston rod axis. The cylinder arm is pivotally connected to the member for pivoting about the second link axis which is parallel to the piston rod axis. The cylinder arm moves through a partially rotated position when the propulsion unit rotates from the center position to either hard over position. The second link axis and the rod axes are on a plane parallel to the steering axis at the partially rotated position.

U.S. Pat. No. 5,092,801, which issued to McBeth on Mar. 3, 1992, describes a hydraulic steering assembly for outboard marine engines. The assembly is connected to the tiller arm of an outboard marine engine and includes a piston rod supported for arcuate movement about the tilt axis while remaining parallel thereto. A hydraulic cylinder travels along the piston rod. An arm extends from the cylinder to a first pivotal member establishing a first pivotal connection about an axis parallel to the tilt axis. A rigid link extends between the first pivotal member and a second pivotal member. The second pivotal member is also connected to the tiller arm and establishes a second pivotal connection about an axis perpendicular to the tilt axis. As the cylinder travels back and forth across the rod, the piston rod oscillates about the tilt axis, the cylinder rotates about the piston rod, the arm rotates about the first pivotal member and the link rotates about the tiller arm in a concerted motion providing a strong and compact linkage arrangement.

U.S. Pat. No. 5,330,375, which issued to Tsujii et al on Jul. 19, 1994, describes a steering system for a marine propulsion unit. The mechanism for a marine outboard drive is disclosed wherein the steering rod connected to the outboard drive end of the wire actuator steering cable is slidably mounted in a guide tube that is formed integrally with the hydraulic assist cylinder and which are affixed to the transom independently of the tilt pin and forwardly of it. This permits the steering mechanism to be assembled as a unit separately from the outboard drive and attached to the transom separately from it.

U.S. Pat. No. 5,542,864, which issued to Peebles on Aug. 6, 1996, describes a steering cylinder for an outboard engine. The cylinder has an elongate interior chamber, a piston movable in the chamber, and a first fluid passage generally parallel to the chamber. In the improvement, the cylinder includes a second fluid passage generally parallel to the chamber and both passages terminate at faces at either end of the cylinder housing. Air bleed fittings and hydraulic fluid fittings are at the faces and, because of such location, jammed and broken fittings and damage to the boat transom and other structure are substantially avoided. Since each passage has both bleed and fluid fittings, it is not necessary to open a fluid fitting to bleed the cylinder during installation.

U.S. Pat. No. 4,710,141, which issued to Ferguson on Dec. 1, 1987, describes a marine propulsion device power steering system. The device includes a propulsion unit mounted for tilting movement about a generally horizontal tilt axis and for pivotal steering movement about a vertical steering axis, and a power steering system adapted to operably connect an actuator to the propulsion system for increasing the steering force applied to the propulsion unit by the actuator. The power steering system is wholly supported on the propulsion unit and includes a hydraulic cylinder-piston assembly having an axis extending in fixed parallel rotation to the tilt axis and including a cylinder, a piston mounted in the cylinder, and an extendable and retractable piston rod connected to the piston rod and a control valve connected to a source of pressurized hydraulic fluid for selectively controlling the flow of hydraulic fluid to and from the opposite sides of the piston to extend and retract the piston rod. The control valve includes a valve member and valve housing rotatably and axially movable relative to each other. The valve member is connected to the actuator and the valve housing is connected to the piston rod for common movement and is connected to the propulsion unit to affect steering movement thereof in response to movement of the actuator.

U.S. Pat. No. 5,924,379, which issued to Masini et al on Jul. 20, 1999, discloses an actuating mechanism with an improved mounting structure. The mechanism is provided with support members that extend away from the centerline of a cylinder bore, piston and actuator rod of an actuation mechanism that uses pressure to move the piston within the cylinder bore. Two support members are attached to a cylinder housing and provided with mounting holes. The two support members are spaced apart from the cylinder housing to allow external support structures to be placed between the cylinder housing and the two support members. Appropriate fasteners, such as bolts, attach each of the two support members to the external support structures in such a way that the cylinder housing can pivot about an axis extending through both bolts. Most importantly, the line extending through the support bolts intersects the cylinder bore at a place between its opposing ends. This reduces the required space necessary to allow the cylinder to pivot properly.

U.S. Pat. No. 5,002,510, which issued to Rump on Mar. 26, 1991, describes a steering mechanism for a marine propulsion device. The invention provides a hydraulic steering assembly for a marine propulsion unit in which the axis of the cylinder travels parallel to the axis of the propulsion unit tilt axis during pivotal steering of the propulsion unit. The steering assembly provides two, two-bar link arms interconnecting the tilt tube and cylinder rod.

U.S. Pat. No. 4,632,049, which issued to Hall et al on Dec. 30, 1986, describes a marine propulsion steering assist device. The device comprises a propulsion unit pivotable about a first steering axis to steer a marine vehicle, a trim tab mounted on the propulsion unit and pivotable about a second steering axis for assisting and steering the vehicle, and a hydraulic sensing arrangement for sensing torque on the propulsion unit relative to the first steering axis to pivot the trim tab in response to the torque. The device also includes steering mechanism for pivoting the propulsion unit about the first steering axis to steer the vehicle. The steering mechanism includes a steering member connected to the propulsion unit, and operable to move the steering member to pivot the propulsion unit. The steering mechanism is operable to move the steering member and includes a push-pull cable with a core and a flexible housing. The hydraulic sensing arrangement permits lost motion between the flexible housing and the steering member and the hydraulic sensing arrangement senses torque on the propulsion unit relative to the first steering axis by movement of the flexible housing relative to the steering member.

U.S. Pat. No. 4,615,290, which issued to Hall on Oct. 7, 1986, describes a marine propulsion steering assist device. The device comprises a propulsion unit pivotable about a first steering axis to steer a marine vehicle, a trim tab mounted on the propulsion unit and pivotable about a second steering axis for assisting in steering the vehicle, and a hydraulic sensing arrangement for sensing torque on the propulsion unit relative to the first steering axis to pivot the trim tab in response to the torque.

U.S. Pat. No. 5,244,426, which issued to Miyashita et al on Sep. 14, 1993, describes a power steering system for an outboard motor. A power steering system for an outboard motor for steering an outboard motor disposed outside of a rear portion of a hull and usually including a manual steering system mounted upon the hull for operating a steering element so as to manually steer the outboard motor body, is disclosed. A power unit is operatively connected to the manual steering system and includes an electric motor for applying a steering assist force to the manual steering system. The power unit is located at the portion of the hull capable of effectively utilizing the inner space of the hull and the electric motor of the power unit is controlled by means of a control unit in accordance with the navigation conditions of the hull and the operating conditions of the outboard motor as detected by means of suitable sensors. The sensors comprise various sensors such as, for example, a steering torque sensor and an engine speed sensor.

The patents described above are hereby explicitly incorporated by reference in the description of the present invention.

Several types of steering cylinders are available from Teleflex Inc. and are commercially available under the Seastar brand. These include a front mount cylinder identified as part number HC5345, a side mount cylinder identified as part number HC5370, and a splashwell mount cylinder identified as part number HC5380. In addition, a steering cylinder is available from the Hynautic Company which is attachable to an existing outboard motor propulsion system.

Steering actuators known to those skilled in the art are typically provided as after-market devices that can be attached to an existing outboard motor. As such, these after-market devices typically exhibit several disadvantages. Many types of steering actuators are placed at a location that is offset from the actual tilt axis of the outboard motor. As a result, tilting the outboard motor causes the actuator to move relative to the transom of a boat and along a path that can interfere with other components. In order to avoid this disadvantage, some after-market steering actuators are placed either to port or starboard from the outboard motor and aligned with the tilt axis of the outboard motor. Although this technique avoids the relative movement of the actuator to the transom when the outboard motor is tilted, it requires additional space for the actuator, either to the port or starboard of the outboard motor.

It would therefore be significantly beneficial if a steering actuator could be located relative to the outboard motor in a position that does not require the actuator to move along a path relative to the transom of the boat as the outboard motor is tilted and, furthermore, it would be beneficial if the steering actuator could be conveniently located in a position that does not require additional space for the actuator components.

SUMMARY OF THE INVENTION

The steering system made in accordance with the preferred embodiment of the present invention comprises a first bracket which is attachable to a transom of a boat and a second bracket which is attached to a marine propulsion unit, such as an outboard motor. The second bracket is rotatable relative to the first bracket about an axis of rotation. The second bracket has a cylindrical portion which is both integral with the second bracket and coaxial with the axis of rotation. It should be understood that the rotation of the second bracket relative to the first bracket is typically in the range of 0 to 90 degrees of rotation. The steering system further comprises an actuator that comprises a cylinder member and a piston member. The actuator is attached to the marine propulsion unit and to the first bracket. The cylinder member and the piston member are both generally coaxial and at least partial concentric with the cylindrical portion of the second bracket. As a result of the construction of the present invention, the marine propulsion unit and the second bracket are both rotatable about the axis of rotation relative to the first bracket.

The cylinder member of the actuator is disposed within the cylindrical portion of the second bracket in a particularly preferred embodiment of the present invention. In addition, the piston member is attached to a first rod that extends axially from the cylindrical portion and is attached to the marine propulsion unit. The first rod is coaxial with the axis of rotation. The first rod is attached to a steering arm of the marine propulsion unit in a preferred embodiment of the present invention and the piston member is attached to a second rod that extends axially from the cylindrical portion in a direction opposite to that of the first rod. The second rod is generally coaxial with the first rod. The cylinder member of the actuator can comprise an outer cylinder and an inner cylinder which are both coaxial and concentric with each other and with the axis of rotation. The present invention can further comprise a position sensor attached to the actuator for detecting the position of the piston member relative to the cylinder member of the actuator. The marine propulsion unit, in a particularly preferred embodiment of the present invention, can be an outboard motor and the actuator can extend through a clearance hole formed within the first bracket. In a preferred embodiment of the present invention, the actuator is a hydraulic actuator.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
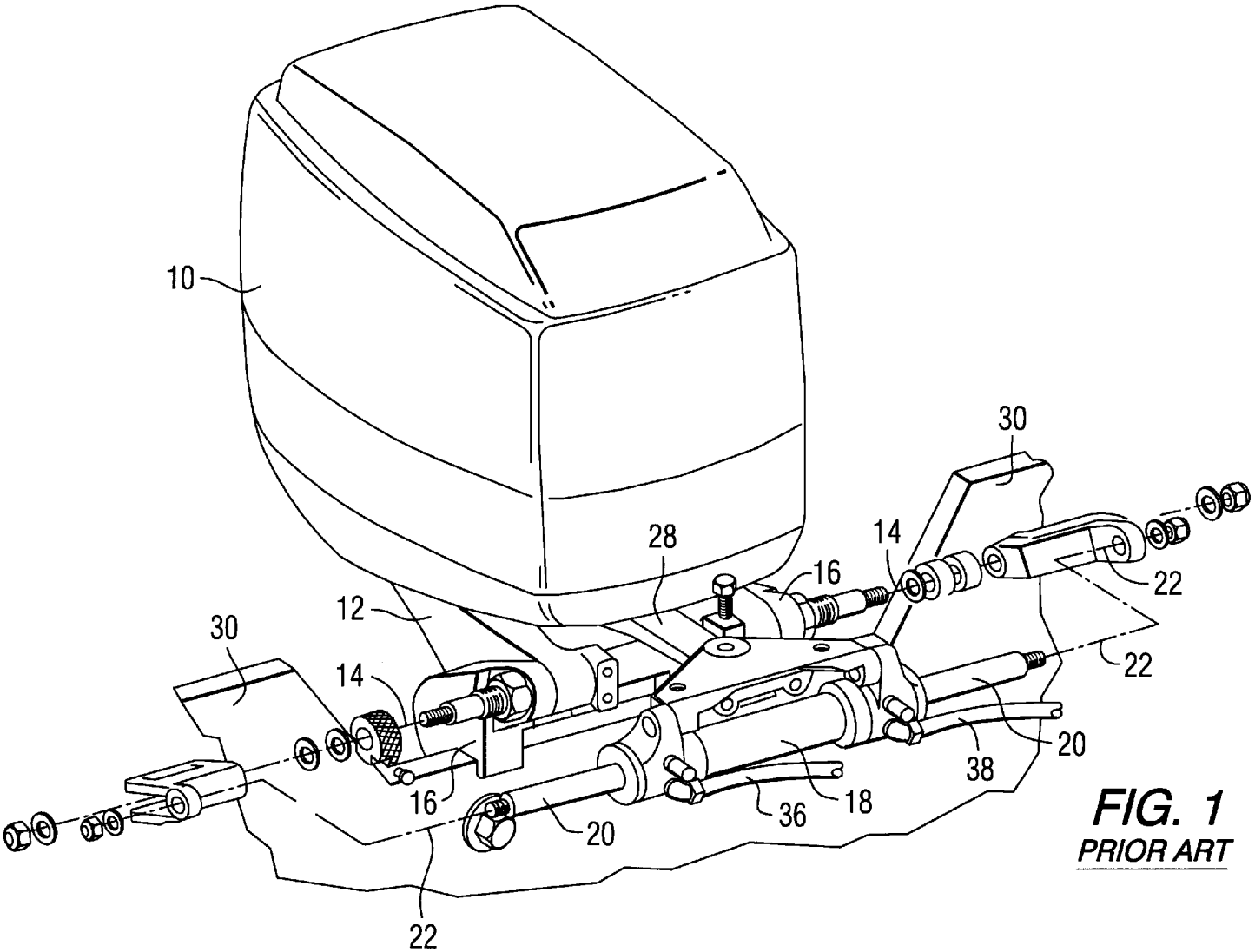
FIG. 1 PRIOR ART
FIG. 1 shows an after-market steering actuator generally known to those skilled in the art.

Throughout the description of the preferred embodiment of the present invention, like components will identified by like reference numerals.

FIG. 1 shows a known type of after-market steering actuator which is available in commercial quantities from the Teleflex Corporation under the brand name Seastar. An outboard motor 10 is attached to a swivel bracket 12 which rotates about an axis of rotation 14 relative to a clamp bracket 16. A cylinder 18 is axially movable relative to a piston rod 20 along axis 22. As can be seen in FIG. 1, axis 22 is generally parallel to the axis of rotation 14, but spaced apart from the axis of rotation 14. A steering arm 28 is attached for movement with the cylinder 18 in an axial direction along axis 22 relative to the piston rod 20. The clamp brackets 16 are attached to the transom 30 of a boat to allow movement of cylinder 18 to affect steering of the outboard motor 10 in response to the flow of pressurized hydraulic fluids within conduits 36 and 38. The flow of hydraulic fluid into the chambers of the cylinder, on either side of the piston within the chamber, causes the cylinder 18 to move relative to the piston rod 20.

Figure 2:
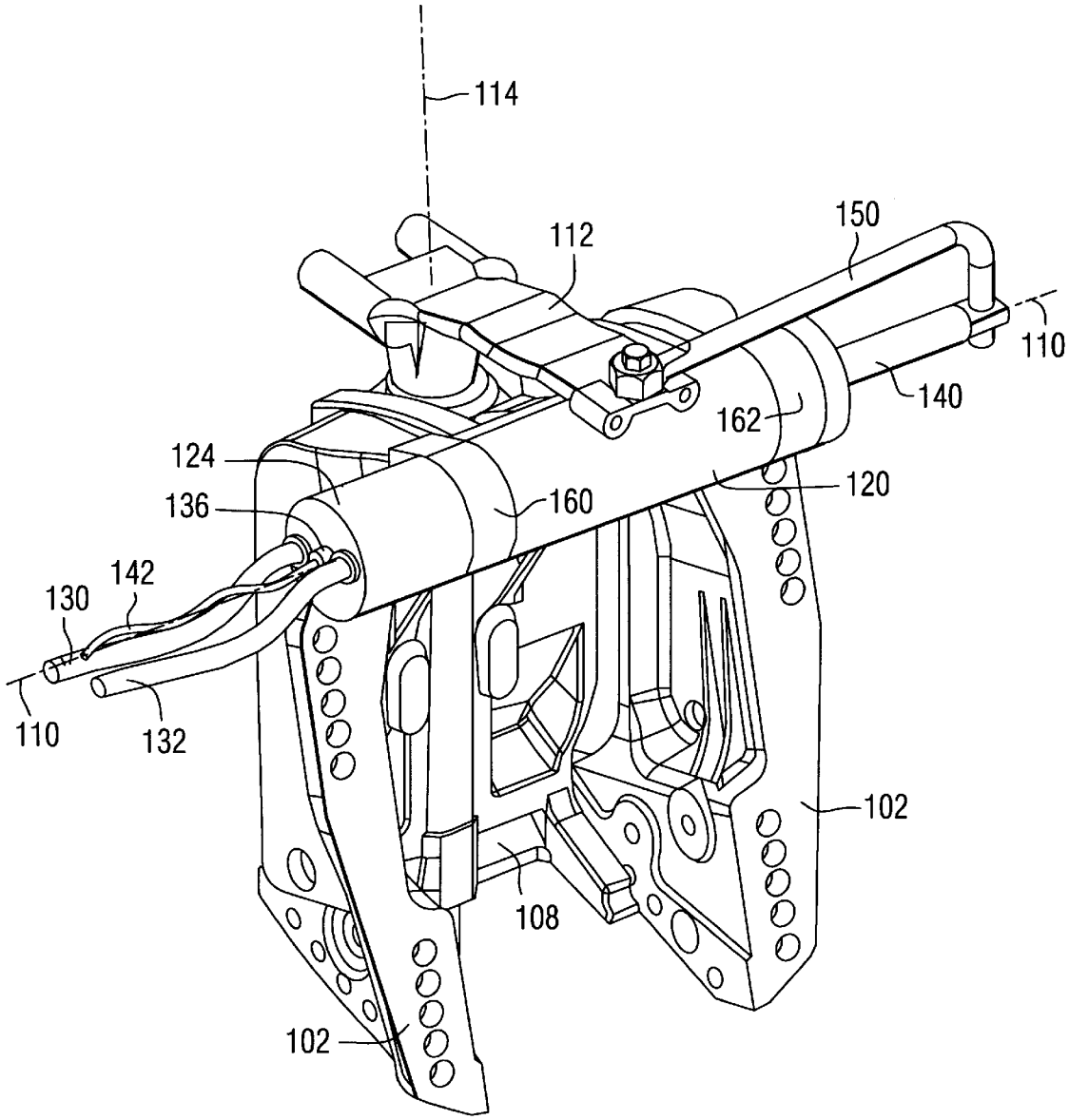
FIG. 2 is an isometric view of one embodiment of the present invention.

FIG. 2 shows the relationship of a hydraulic actuator and the brackets in a preferred embodiment of the present invention. Two clamp brackets 102 are attachable to a transom of a boat, in a manner similar to that described above in conjunction with FIG. 1. A swivel bracket 108 is rotatable relative to the clamp brackets 102. The swivel bracket 108 is attachable to an outboard motor (not shown in FIG. 2) to allow the outboard motor to rotate with the swivel bracket 108 relative to the clamp brackets 102 and about an axis of rotation 110. The steering arm 112 rotates with the swivel bracket 108 and is also rotatable, about axis 114, relative to the swivel bracket 108. The swivel bracket 108 has a cylindrical portion 120 which, in a particularly preferred embodiment of the present invention, is formed as an integral part of the swivel bracket 108. The cylindrical portion 120 is coaxial with the axis of rotation 110. An actuator (not shown in FIG. 2), which comprises a cylinder member and a piston member, is attached to the marine propulsion unit and to the clamp brackets 102. The cylinder member and the piston member of the actuator are both generally coaxial and at least partially concentric with the cylindrical portion 120 of the swivel bracket 108. The actuator, comprising the cylinder member and piston member, is disposed inside the cylindrical portion 120 in FIG. 2, but will be described in greater detail below in conjunction with FIG. 3. A manifold 124 is attached to the actuator and connected in fluid communication with the cylinder member of the actuator. Hydraulic conduits, 130 and 132, are connected to the manifold 124 to provide the flow of hydraulic fluid to and from the actuator. A position sensor 136 is provided for the purpose of determining the precise axial position of a first rod 140 that is attached to the piston member of the actuator. An electrical conduit 142 is provided to transmit signals from the position sensor 136 to an external controller. The first rod 140 is connected by link 150 to the steering arm 112. As the piston is caused to move within the cylinder of the actuator, the first rod 140 moves with the piston because it is attached to the piston. This, in turn, moves the link 150 which moves the steering arm 112 about axis 114.

With continued reference to FIG. 2, it can be seen that rotation of the swivel bracket 108 relative to the clamp brackets 102 will cause the steering arm 112, link 150, and first rod 140 to rotate about the axis of rotation 110 in unison with each other. Rotation about axis 110 will cause no relative movement between any of these components. Therefore, the outboard motor, the steering arm 112, the link 150, the first rod 140, and the swivel bracket 108 will not move relative to each other as a result of rotation of the swivel bracket 108 about the axis of rotation 110. This characteristic of the present invention distinguishes it from most known types of after-market steering actuators. Furthermore, the actuator is disposed within the cylindrical portion 120 of the swivel bracket 108 and this places the actuator in both concentric and coaxial relation with the cylindrical portion 120.

The clamp brackets 102 are provided with extensions, 160 and 162, which have clearance holes formed through them to allow the actuator to function as described above. From the manifold 124, hydraulic fluid flows through the clearance hole in extension 160 and the first rod 140 moves axially along the axis of rotation 110 through a clearance hole formed in extension 162.

Figure 3:
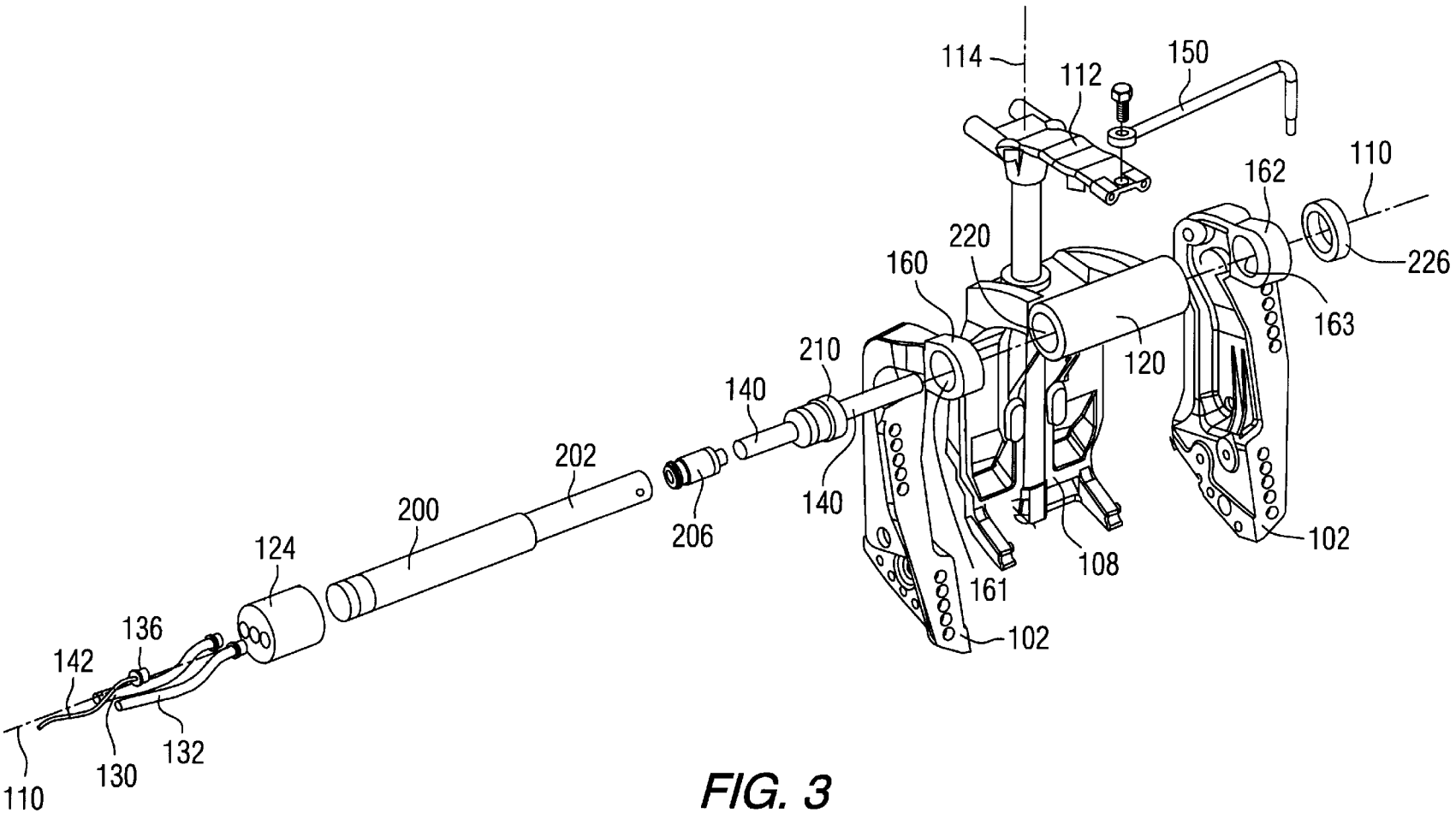
FIG. 3 is an exploded view of the embodiment of FIG. 2.

FIG. 3 is an exploded view of the embodiment of the present invention shown in the assembled view of FIG. 2. The actuator comprises an outer cylinder 200 and an inner cylinder 202 which is shaped to receive a piston 206. The outer cylinder 200 and inner cylinder 202, as will be described in greater detail below, are arranged to conduct hydraulic fluid to both sides of the piston 206 within the inner cylinder 202. The hydraulic fluid flows from the manifold 124 and is contained by a cylinder end cap 210. The first rod 140 is connected to the piston 206 to move in coordination with the piston along the axis of rotation 110. The inner and outer cylinders, 202 and 200, the piston 206, and at least a portion of the first rod 140 are disposed within the internal cylindrical cavity 220 of the cylindrical portion 120 of the swivel bracket 108. As shown in FIG. 3, the cylindrical portion 120 is an integral part of the swivel bracket 108, but it should be understood that the cylindrical portion 120 can be an individual component that is attached to the swivel bracket 108. A cylinder nut 226 combines with the manifold 124 to attach the actuator structure to both the clamp brackets 102 and swivel bracket 108. The cylinder nut 226 prevents axial movement of the actuator assembly relative to the clamp brackets 102 and swivel bracket 108 along the axis of rotation 110 while allowing the swivel bracket to rotate about the axis of rotation 110 relative to the clamp brackets 102.

Figure 4:
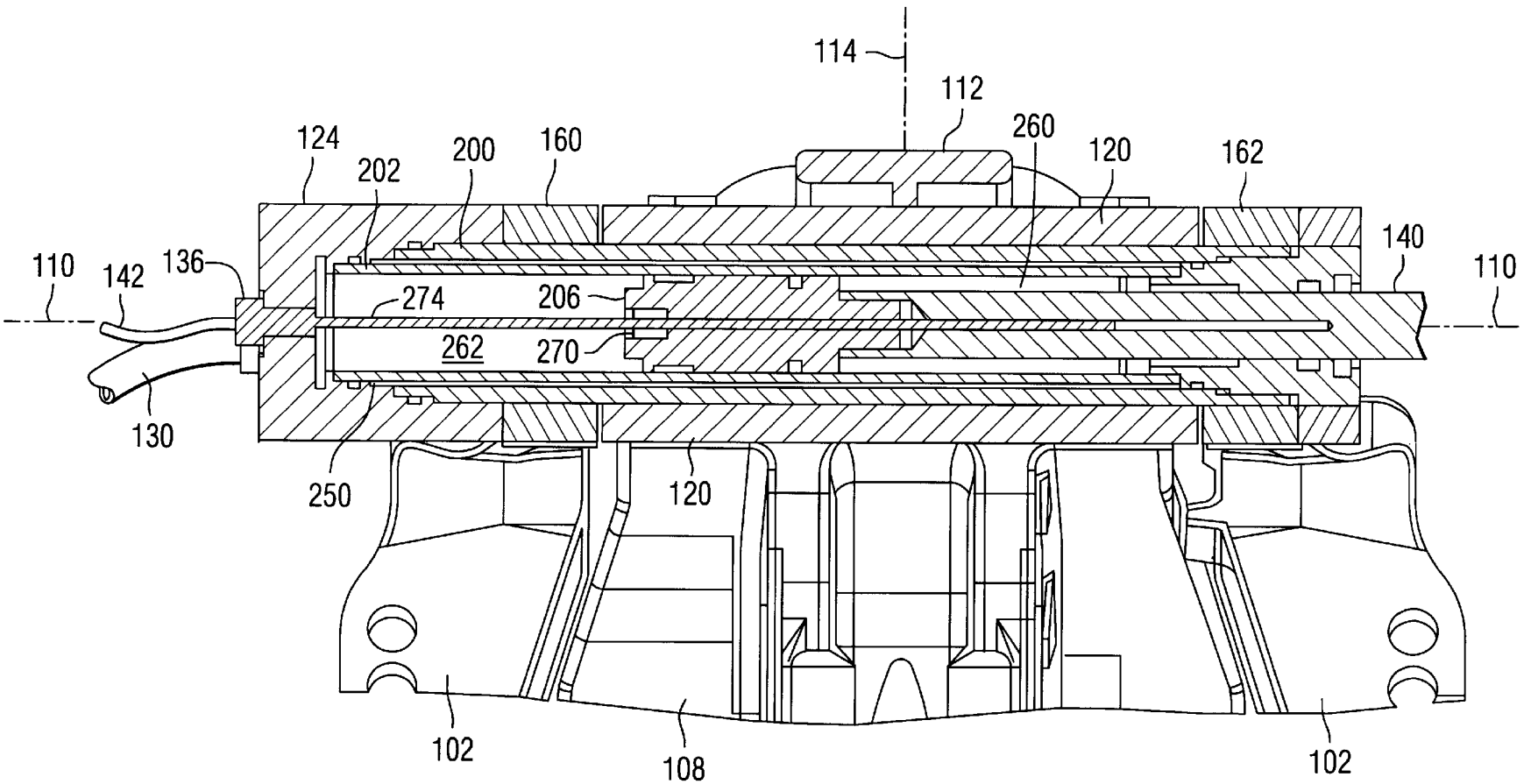
FIG. 4 is a section view of one embodiment of the present invention showing the internal components of its actuator.

FIG. 4 is a section view showing the internal components of the actuator. The cylindrical portion 120 is an integral part of the swivel bracket 108 and is retained between the extensions, 160 and 162, which contain the clearance holes, 161 and 163, which are identified in FIG. 3 and described above.

As can be seen in FIG. 4, a space 250 exists between the inner cylinder 202 and the outer cylinder 200. This space 250 provides a passage through which hydraulic fluid can flow from the manifold 124 to the space 260 at the right side of the piston 206. Oil can also flow through the manifold 124 and into the space 262 on the left side of the piston 206. The precise position of the piston 206 can be determined by the sensor 136 by detecting the position of a sensor element 270, which is attached to the piston 206, relative to the rod 274 attached to the sensor 136. The first rod 140 is attached to the piston 206 for movement with it along the axis of rotation 110.

Figure 5:
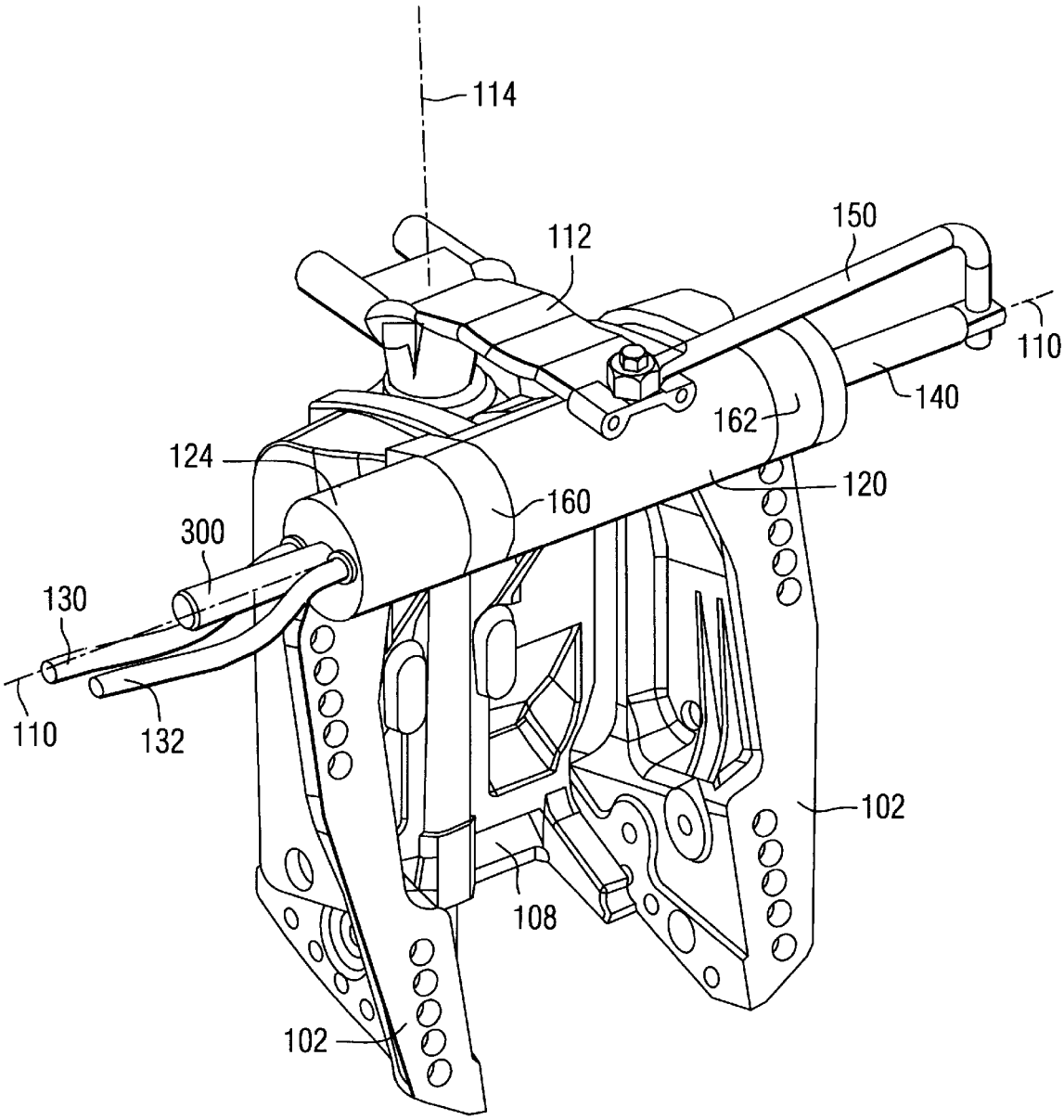
FIG. 5 is an alternative embodiment of the present invention with two rods extending from its actuator's piston.

The embodiment of the present invention shown in FIG. 5 is generally similar to that shown in FIG. 2, but the embodiment in FIG. 5 has a second rod 300 attached to the piston within the inner cylinder that is disposed inside the cylindrical cavity of the cylindrical portion 120. The other components shown in FIG. 5 are essentially identical to those shown in FIG. 2, except for the removal of the sensor 136 from the manifold 124 and its replacement with a clearance opening through which the second rod 300 extends. When the piston moves within the inner cylinder of the actuator, the first rod 140 and second rod 300 move in coordination with the piston along the axis of rotation 110. The first and second rods, 140 and 300, are both attached to the piston and extend in opposite directions from the piston through the clearance holes of the extensions, 160 and 162. The primary advantage of providing a second rod 300 attached to the piston is that it equalizes the surface area on both sides of the piston and, as a result, equalizes the force on the piston during turns toward port and toward starboard. This feature also equalizes volume on both sides of the piston which equalizes the number of steering wheel turns in both directions.

Figure 6:
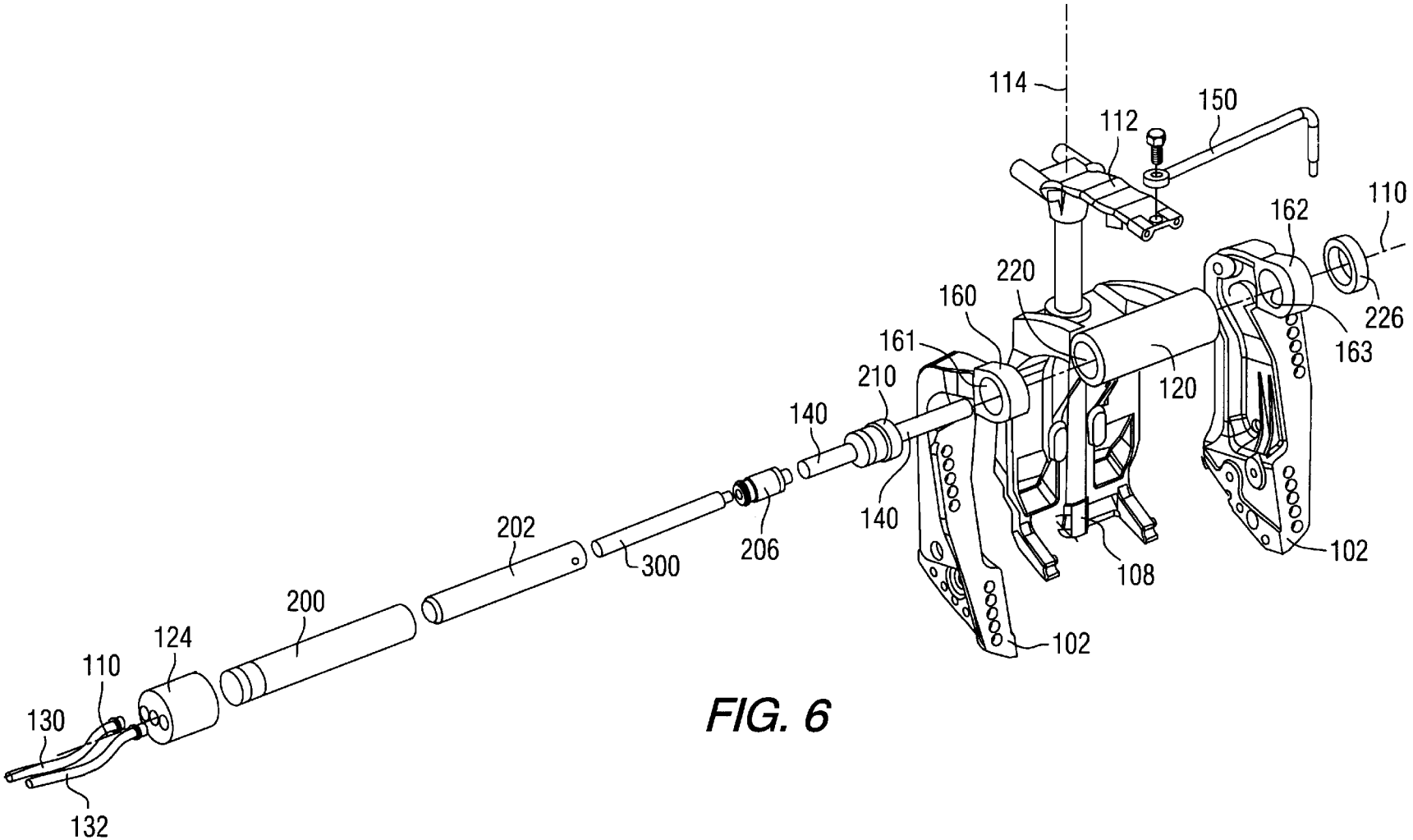
FIG. 6 is an exploded view of the embodiment of FIG. 5.

FIG. 6 is an exploded view of the embodiment of the present invention shown in FIG. 5. It is very similar to the exploded view of FIG. 3, but with the addition of the second rod 300 attached to the piston 206 and disposed within the inner cylinder 202. The second rod 300 extends along the axis of rotation 110 and through the manifold 124, unlike the embodiment shown in FIG. 3 in which no second rod 300 is provided. It should be understood that the embodiments shown in FIGS. 3 and 6 are generally identical in operation with respect to the present invention, but the embodiment shown in FIG. 6 is provided with a second rod 300 to equalize the forces on the piston 206 in both directions, whereas the absence of the second rod 300 in the embodiment of FIG. 3 may create an imbalance of the forces on the piston 206, with a greater force being exerted toward the right in FIG. 3 than toward the left as a result of the unequal surface areas of the piston 206 on which the hydraulic pressure acts.

Figure 7:
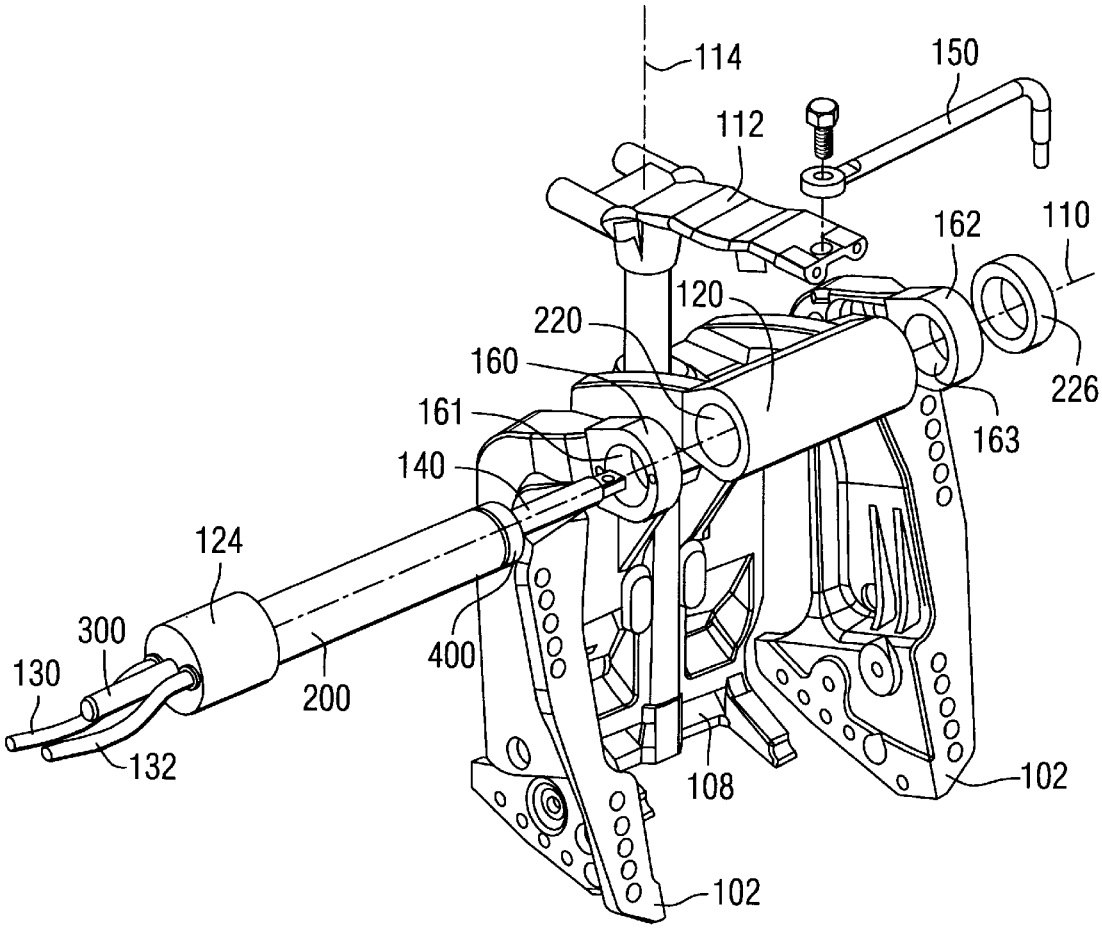
FIG. 7 is a partially exploded view of the embodiment of FIG. 5 showing an assembled actuator removed from its operative location.

FIG. 7 is an exploded view of the embodiment shown in FIG. 5, but with the actuator assembled and removed from the cavity 220 of the cylindrical portion 120. The end cap 210, shown in FIG. 6, is provided with a threaded end portion 400 that is threaded and shaped to receive the cylinder nut 226. When the actuator is moved through the clearance hole 161, cavity 220 of the cylindrical portion 120, and clearance hole 163, the cylinder nut 226 is threaded unto the threaded end 400 to firmly attach the actuator to both the clamp brackets 102 and swivel bracket 108. This arrangement allows the swivel bracket 108 to rotate about the axis of rotation 110. As in the embodiment described above in conjunction with FIG. 2, rotation of the swivel bracket 108 and its attached outboard motor relative to the clamp brackets 102 does not cause any relative movement between the cylindrical portion 120, the link 150, the steering arm 112, or the swivel bracket 108. This function provides a significant benefit with respect to the prior art. In addition, the placement of the actuator within the cavity 220 of the cylindrical portion 120 of the swivel bracket 108 efficiently uses the space within the cylindrical portion 120. Furthermore, the placement of the actuator within the cylindrical portion 120 protects the actuator from damage.

With continued reference to FIG. 7, it can be seen that a first bracket, or clamp bracket 102, is attachable to a transom of a boat. A second bracket, or swivel bracket 108, can be attached to a marine propulsion unit, such as an outboard motor. The second bracket is rotatable relative to the first bracket about an axis of rotation 110. The second bracket, or swivel bracket 108, has a cylindrical portion 120 which is attached to the swivel bracket 108 and can be an integral part of the swivel bracket 108. Cylindrical portion 120 is coaxial with the axis of rotation 110. The actuator, which comprises the inner and outer cylinders, 202 and 200, the piston 206, and the attached rods, 140 and 300, is disposed within the cavity 220 of the cylindrical portion 120. In addition, the cylinder member and piston member are generally coaxial and at least partially concentric with the cylindrical portion 120 of the second bracket, or swivel bracket 108. As a result, the marine propulsion unit and the second bracket are both rotatable about the axis of rotation 110 relative to the first bracket, or clamp bracket 102.

It can also be seen in FIG. 7 that the cylinder member, such as the inner cylinder 202 within the outer cylinder 200, is disposed within the cylindrical portion 120 of the second bracket, or swivel bracket 108. The piston member 206 is attached to the first rod 140 which extends axially from the cylindrical portion 120 and is attached to the marine propulsion unit by the link 150. The first rod 140 is coaxial with the axis of rotation 110. More particularly, the first rod 140 is attached to a steering arm 112 of the marine propulsion unit. The piston member 206 can be attached to a second rod 300 that extends axially from the cylindrical portion 120 in a direction opposite to that of the first rod 140. The second rod 300 is generally coaxial with the first rod 140 and also coaxial with the axis of rotation 110. The cylinder member of the actuator comprises an outer cylinder 200 and an inner cylinder 202 which are both coaxial and concentric with each other and with the axis of rotation 110. In addition, they are both at least partially concentric with the cylindrical portion 120 and disposed within the cavity 220 of the cylindrical portion 120.

The actuator extends through clearance holes, 161 and 163, formed within the clamp bracket 102. In a particularly preferred embodiment of the present invention, the actuator is a hydraulic actuator and hydraulic liquid is used to move the piston 206 within the inner cylindrical cavity of the inner cylinder 202.

Although the present invention has been described with particular detail and illustrated with specificity, it should be understood that alternative embodiments are also within its scope.

What is claimed is:

1. A steering system for a marine propulsion system, comprising:

a first bracket which is attachable to a transom of a boat;

a second bracket which is attached to a marine propulsion unit, said second bracket being rotatable relative to said first bracket about an axis of rotation, said second bracket having a generally cylindrical portion which is both attached to said second bracket and coaxial with said axis of rotation;

an actuator comprising a cylinder member and a piston member, said actuator being attached to said marine propulsion unit and to said first bracket, said cylinder member and said piston member both being generally coaxial and at least partially concentric with said generally cylindrical portion of said second bracket, said cylinder member of said actuator being disposed within said generally cylindrical portion of said second bracket, and said generally cylindrical portion is integral with said second bracket; and whereby said marine propulsion unit and said second bracket are both rotatable about said axis of rotation relative to said first bracket.

2. The steering system of claim 1, wherein:

said piston member is attached to a first rod that extends axially from said generally cylindrical portion and is attached to said marine propulsion unit, said first rod being coaxial with said axis of rotation.

3. The steering system of claim 2, wherein:

said first rod is attached to a steering arm of said marine propulsion unit.

4. The steering system of claim 2, wherein:

said piston member is attached to a second rod that extends axially from said generally cylindrical portion in a direction opposite to that of said first rod, said second rod being generally coaxial with said first rod.

5. The steering system of claim 1, wherein:

said cylinder member of said actuator comprises an outer cylinder and an inner cylinder which are both coaxial and concentric with each other and with said axis of rotation.

6. The steering system of claim 1, further comprising:

a position sensor attached to said actuator for detecting the position of said piston member relative to said cylinder member.

7. The steering system of claim 1, wherein:

said marine propulsion unit is an outboard motor.

8. The steering system of claim 1, wherein:

said actuator extends through a clearance hole formed within said first bracket.

9. The steering system of claim 1, wherein:

said actuator is a hydraulic actuator.

10. A steering system for a marine propulsion system, comprising:

a first bracket which is attachable to a transom of a boat;

a second bracket which is attached to a marine propulsion unit, said second bracket being rotatable relative to said first bracket about an axis of rotation, said second bracket having a generally cylindrical portion which is both integral with said second bracket and coaxial with said axis of rotation;

an actuator comprising a cylinder member and a piston member, said actuator being attached to said marine propulsion unit and to said first bracket, said cylinder member and said piston member both being generally coaxial and at least partially concentric with said generally cylindrical portion of said second bracket, said cylinder member of said actuator being disposed within said generally cylindrical portion of said second bracket, said piston member being attached to a first rod that extends axially from said generally cylindrical portion and is attached to said marine propulsion unit, said first rod being coaxial with said axis of rotation; and whereby said marine propulsion unit and said second bracket are both rotatable about said axis of rotation relative to said first bracket.

11. The steering system of claim 10, wherein:

said first rod is attached to a steering arm of said marine propulsion unit.

12. The steering system of claim 11, wherein:

a position sensor attached to said actuator for detecting the position of said piston member relative to said cylinder member.

13. The steering system of claim 12, wherein:

said cylinder member of said actuator comprises an outer cylinder and an inner cylinder which are both coaxial and concentric with each other and with said axis of rotation.

14. The steering system of claim 13, further comprising:

said piston member is attached to a second rod that extends axially from said generally cylindrical portion in a direction opposite to that of said first rod, said second rod being generally coaxial with said first rod.

15. The steering system of claim 14, wherein:

said marine propulsion unit is an outboard motor.

16. The steering system of claim 15, wherein:

said actuator extends through a clearance hole formed within said first bracket.

17. The steering system of claim 16, wherein:

said actuator is a hydraulic actuator.

18. A steering system for a marine propulsion system, comprising:

a first bracket which is attachable to a transom of a boat;

a second bracket which is attached to a marine propulsion unit, said second bracket being rotatable relative to said first bracket about an axis of rotation, said second bracket having a generally cylindrical portion which is both integral with said second bracket and coaxial with said axis of rotation;

an actuator comprising a cylinder member and a piston member, said actuator being attached to said marine propulsion unit and to said first bracket, said cylinder member and said piston member both being generally coaxial and at least partially concentric with said generally cylindrical portion of said second bracket, said cylinder member of said actuator being disposed within said generally cylindrical portion of said second bracket, said piston member being attached to a first rod that extends axially from said generally cylindrical portion and is attached to said marine propulsion unit, said first rod being coaxial with said axis of rotation, said first rod being attached to a steering arm of said marine propulsion unit, whereby said marine propulsion unit and said second bracket are both rotatable about said axis of rotation relative to said first bracket; and a position sensor attached to said actuator for detecting the position of said piston member relative to said cylinder member, said cylinder member of said actuator comprising an outer cylinder and an inner cylinder which are both coaxial and concentric with each other and with said axis of rotation, said piston member being attached to a second rod that extends axially from said generally cylindrical portion in a direction opposite to that of said first rod, said second rod being generally coaxial with said first rod, said actuator extending through a clearance hole formed within said first bracket.

19. The steering system of claim 18, wherein:

said actuator is a hydraulic actuator.

* * * * *